US006095965A

United States Patent [19]

Eiderman et al.

[11] Patent Number: 6,095,965

[45] Date of Patent: Aug. 1, 2000

[54] CENTRIFUGAL SEPARATOR FOR DRY COMPONENTS

[75] Inventors: Boris Eiderman, Jerusalem; Boris Rozenwald, Mevasseret Zion, both of Israel

[73] Assignee: Sortech Separation Technologies Ltd., Jerusalem, Israel

[21] Appl. No.: 08/907,012

[22] Filed: Aug. 6, 1997

[51] Int. Cl.[7] ..... B04B 7/08; B04B 11/00

[52] U.S. Cl. ..... 494/80; 494/26; 494/56; 494/63; 494/67

[58] Field of Search ..... 494/14, 25, 26, 494/34, 36, 44, 59, 61, 60, 63, 67, 80, 56

[56] References Cited

U.S. PATENT DOCUMENTS

| | | | |
|---|---|---|---|
| 379,133 | 3/1888 | Shepard | 494/80 |
| 471,614 | 3/1892 | Kerr | 494/60 |
| 489,101 | 1/1893 | Seymour . | |
| 556,567 | 3/1896 | Waring | 494/80 |
| 621,306 | 3/1899 | Kneeland et al. | 494/67 |
| 726,948 | 5/1903 | Land | 494/67 |
| 736,976 | 8/1903 | Keiper . | |
| 1,216,118 | 2/1917 | Hering | 494/44 |
| 1,283,846 | 11/1918 | Mark et al. | 494/60 |
| 1,322,139 | 11/1919 | Schifferle | 494/44 |
| 1,473,421 | 11/1923 | Eccleston | 494/60 |
| 1,594,501 | 8/1926 | Eccleston | 494/60 |
| 1,599,502 | 9/1926 | Thomassen | 494/60 |
| 1,684,870 | 9/1928 | Lewis | 494/80 |
| 1,712,184 | 5/1929 | Wendel . | |
| 1,750,860 | 3/1930 | Rawlings | 494/44 |
| 1,896,180 | 2/1933 | Lindequist | 494/44 |
| 1,935,547 | 11/1933 | Dryhurst | 494/67 |
| 1,988,500 | 1/1935 | Lack | 494/44 |
| 2,056,888 | 10/1936 | Pecker | 494/36 |
| 2,112,099 | 3/1938 | Ballou et al. | 494/67 |
| 2,230,013 | 1/1941 | Pecker | 494/80 |
| 2,415,210 | 2/1947 | Hoefling . | |
| 2,472,475 | 6/1949 | Hamilton | 494/36 |
| 2,692,832 | 10/1954 | Hensgen | 494/36 |
| 3,256,993 | 6/1966 | Siepe et al. | 494/44 |
| 3,366,318 | 1/1968 | Steimal . | |
| 3,507,479 | 4/1970 | Pearl | 494/59 |
| 4,072,266 | 2/1978 | Dietzel . | |
| 4,608,040 | 8/1986 | Knelson | 494/80 |
| 5,222,933 | 6/1993 | Knelson et al. | 494/80 |
| 5,300,013 | 4/1994 | Frässdorf et al. . | |
| 5,372,571 | 12/1994 | Knelson et al. . | |
| 5,895,345 | 4/1999 | Knelson | 494/80 |

FOREIGN PATENT DOCUMENTS

| | | | |
|---|---|---|---|
| 96/37307 | 11/1996 | WIPO | 494/80 |

*Primary Examiner*—Charles E. Cooley
*Attorney, Agent, or Firm*—Greenblum & Bernstein, P.L.C.

[57] ABSTRACT

A centrifugal separator for separating two components of a dry mixture has an annular surface inclined upwardly outwards and having a vertical axis of symmetry and a drive mechanism for rotating the surface around the vertical axis of symmetry. A centrally located feed mechanism feeds the mixture onto the surface. At least a first part of the surface is configured such that particles of one component are retained on the surface while particles of the other component progress upwards across the surface and over the upper edge. The separation process may be based on ridges or barriers which prevent upward movement of small particles, or on frictional differentials between types or shapes of particles. Multiple concentric surfaces may be used to separate mixtures in multiple components.

15 Claims, 7 Drawing Sheets

CENTRIFUGAL SEPARATOR FOR DRY COMPONENTS

FIELD AND BACKGROUND OF THE INVENTION

The present invention relates to separators and, in particular, it concerns centrifugal separators suitable for separating dry components.

A wide range of techniques are in common use for separating mixtures into their different components. The most common technique used for dry separation involves the use of a vibrating mesh or sieve. However, sieve-based techniques suffer from a number of limitations. When used for very small or irregular particles, the sieve tends to become blocked. Sieves are also unable to separate particles of similar dimensions with different shapes or roughnesses (morphology).

An alternative technique for dry separation employs vibrating surfaces without the use of a sieve. This technique is very slow, and also generates a lot of dust.

A further technique for dry separation involves the use of a stream of air passing through the mixture, tending to carry with it smaller lighter particles. Air-flow based techniques are suitable for separating small particles. However, since they require a two stage process of separation followed by removal of particles from the air stream, they are costly to implement. Air-flow based techniques are also unable to separate particles of similar dimensions and weights which have different morphology.

Because of the limitations and disadvantages of the aforementioned dry separation methods, a range of liquid based, or "wet" separation techniques are in common use. These techniques, based on the different densities of particles, include floatation and centrifugal techniques. However, wet techniques have additional disadvantages. Firstly, mixing with water may damage certain materials. Even where damage is not caused, considerable additional time and expense is involved in subsequent drying of the materials. Here too, particles cannot be separated according to their morphology.

Turning now specifically to the prior art centrifugal techniques, examples are disclosed in U.S. Pat. No. 489,101 to Seymour; U.S. Pat. No. 736,976 to Keiper; U.S. Pat. No. 1,712,184 to Wendel; U.S. Pat. No. 1,750,860 to Rawlings; U.S. Pat. No. 1,935,547 to Dryhurst; U.S. Pat. No. 2,415,210 to Hoefling; U.S. Pat. No. 3,366,318 to Steimel; U.S. Pat. No. 4,072,266 to Dietzel; U.S. Pat. No. 4,608,040 to Knelson; U.S. Pat. No. 5,300,013 to Frassdorf et al.; and U.S. Pat. No. 5,372,571 to Knelson et al. These examples typically employ a revolving bowl with a liquid working medium in which heavy particles settle downwards while lighter particles are carried upwards by the liquid flow. The physical process involved is an interaction between gravitational settling and liquid flow forces.

Worthy of particular mention for its resemblance to the present invention, U.S. Pat. No. 1,935,547 to Dryhurst discloses a rotating bowl with riffled inserts for separating ore. Although use of a liquid working medium is not mentioned explicitly, the somewhat terse description describes the coarse riffles as retaining the heavier particles while the while the dirt and other refuse passes over (see lines 78–85). However, it is clear that, in the absence of a liquid working medium, the opposite would occur, with small particles becoming trapped within the riffles. Furthermore, the near vertical walls of the bowl and the additional barrier formed by V-shaped corners of the riffles would render the device inoperative in the absence of a liquid medium. It is clear, therefore, that Dryhurst relates to a liquid based centrifugal separator similar in principle to the other references mentioned above.

There is therefore a need for an apparatus and method for separation of dry components which is simple and cost effective, avoids generation of dust, allows separation of small particles and provides for separation of components according to their morphology.

SUMMARY OF THE INVENTION

The present invention is a centrifugal separator and corresponding method for centrifugal separation of dry components according to their different frictional interactions with a rotating annular surface.

According to the teachings of the present invention there is provided, a centrifugal separator for separating a first component of a dry mixture from a second component of the dry mixture, the separator comprising: (a) an annular surface inclined upwardly outwards and having a vertical axis of symmetry, the annular surface having an upper edge and a lower edge; (b) a drive mechanism coupled to the annular surface for rotating the surface around the vertical axis of symmetry; and (c) a feed mechanism located centrally with respect to the surface for feeding the mixture onto the surface, wherein at least a first part of the surface is configured such that particles of the first component are retained on the part of the surface while particles of the second component progress upwards across the surface and over the upper edge.

According to a further feature of the present invention, there is also provided a suction system for causing a flow of air downwards within the surface so as to draw dust past the lower edge.

According to a further feature of the present invention, there is also provided a mesh associated with, and extending substantially horizontally within, the surface proximal to the upper edge, the mesh being configured to generate turbulent air flow without obstructing passage of large particles.

According to a further feature of the present invention, there is also provided a collection chute positioned below the lower edge of the surface, the chute being switchably associated with two outlets to allow segregation of outputs during and after rotational separation.

According to a further feature of the present invention, there is also provided a secondary annular rotating surface circumscribing the upper edge of the surface, the secondary surface being inclined upwardly outwards.

According to a further feature of the present invention, there is also provided a secondary annular rotating surface circumscribing the upper edge of the surface, the secondary surface being inclined downwardly outwards.

According to a further feature of the present invention, the first component has a first effective friction coefficient against the first part of the surface, and the second component has a second effective friction coefficient against the first part of the surface, the second friction coefficient being smaller than the first friction coefficient, the first part of the surface being inclined at an angle to the vertical chosen such that particles of the first component are retained on the part of the surface by friction while particles of the second component progress upwards across the annular surface and over the upper edge.

According to a further feature of the present invention, the first part of the surface is textured to render the first effective friction coefficient greater than an inherent friction coefficient between materials of the first component and the surface.

According to a further feature of the present invention, the first part of the surface is proximal to the upper edge, the angle being between about 1° and about 5° greater than the arctangent of the second effective friction coefficient.

According to a further feature of the present invention, the surface further includes an accelerator surface, adjacent to the lower edge, the accelerator surface being inclined at an angle to the vertical of greater than the arctangent of the first effective friction coefficient.

According to a further feature of the present invention, the surface further includes a second part, intermediate between the first part and the accelerator surface, the second part being inclined at an angle to the vertical of between about 5° and about 10° greater than the arctangent of the second effective friction coefficient.

According to a further feature of the present invention, each of the accelerator surface, the first part and the second part are implemented as substantially conical surfaces.

According to a further feature of the present invention, the first component has a particle size of less than a given diameter D, and the second component has a particle size of greater than diameter D, wherein the first part of the surface is formed with barriers configured such that particles of the first component become trapped against the barriers while particles of the second component progress upwards across the annular surface and over the upper edge.

According to a further feature of the present invention, D is less than about 1 mm.

According to a further feature of the present invention, D is less than about 40 $\mu$m.

According to a further feature of the present invention, the first part of the surface has a first inclination to the vertical, the surface further including an accelerator surface having a second inclination to the vertical, the second inclination being greater than the first inclination.

According to a further feature of the present invention, the feed mechanism includes a rotating disk.

There is also provided according to the teachings of the present invention, a method for centrifuigal separation of a first component of a dry mixture from a second component of the dry mixture, the method comprising: (a) providing an annular surface inclined upwardly outwards and having a vertical axis of symmetry, the annular surface having an upper edge and a lower edge; (b) driving the annular surface so as to cause the surface to rotate around the vertical axis of symmetry; and (c) delivering the dry mixture onto the surface, wherein at least a first part of the surface is configured such that particles of the first component are retained on the part of the surface while particles of the second component progress upwards across the surface and over the upper edge.

According to further features of the present invention, the method may employ an apparatus having any of the aforementioned structural features.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a centrifugal separator and corresponding method for centrifugal separation of dry components according to their different frictional interactions with a rotating annular surface.

The principles and operation of centrifugal separators and corresponding methods according to the present invention may be better understood with reference to the drawings and the accompanying description.

Figure 1:
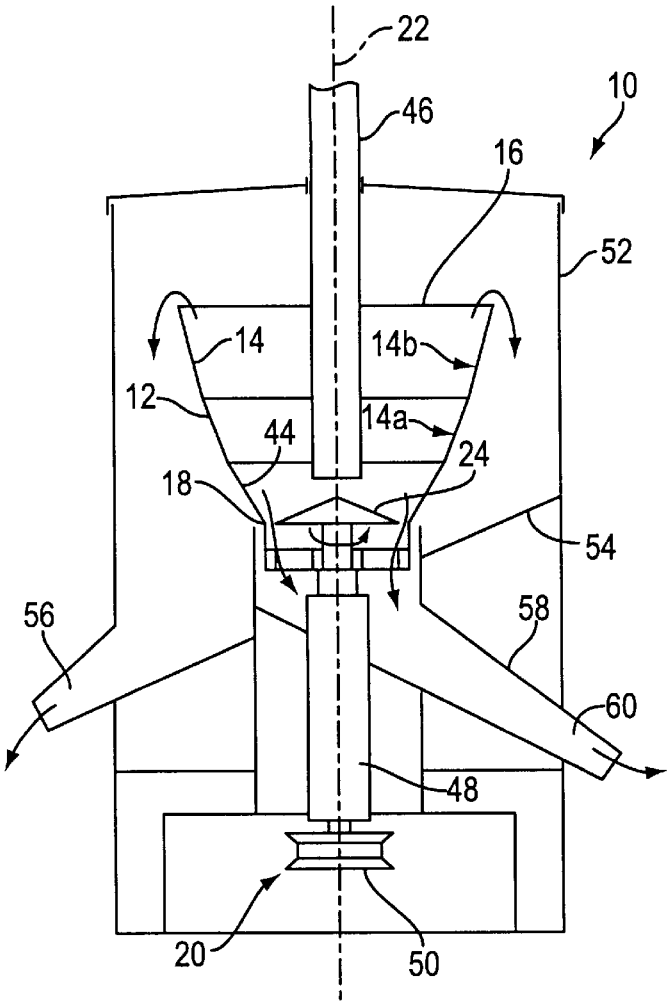
FIG. 1 is a side cross-sectional view of a first embodiment of a centrifugal separator, constructed and operative according to the teachings of the present invention, employing a conical-section bowl for separating dry components.

Referring now to the drawings, a first embodiment of the present invention will be described with reference to FIGS. 1–6. Thus, FIG. 1 shows a centrifugal separator, generally designated 10, constructed and operative according to the teachings of the present invention, for separating a first component of a dry mixture from a second component of the dry mixture.

Generally speaking, centrifugal separator 10 includes a rotatable bowl 12 which provides an annular surface 14 which is inclined upwardly outwards. Annular surface 14 is bounded by an upper edge 16 and a lower edge 18. A drive mechanism 20 is coupled to bowl 12 so as to turn it about its vertical axis of symmetry, denoted 22. A feed mechanism 24, located centrally within bowl 12, feeds the mixture onto surface 14. At least part of surface 14 is configured such that particles of the first component of the mixture are retained on surface 14 while particles of the second component progress upwards across surface 14 and over upper edge 16.

The term "annular" employed to describe surface 14 is used herein in the description and claims to refer to any substantially continuous surface which is approximately symmetrical under rotation about a central axis. Parenthetically, it should be emphasized that the symmetry mentioned need not be precise, especially with respect to surface features of the surface. As will be apparent from the embodiments described, examples of the annular surface include, but are not limited to, surfaces made up from one or more sections of different cones, and rounded bowl-like shapes.

It should be appreciated that, in contrast to the liquid-based prior art devices discussed above, centrifugal separator 10 operates without any liquid by frictional and mechanical interaction between the components of the mixture and surface 14. Consequently, the separation process is governed by the inclination of surface 14 to the vertical and its surface characteristics. By identifying the mechanical characteristics of the components in question and choosing appropriate surface characteristics and angles, it is possible to achieve highly reliable separation, not only of different sized particles, but also of particles of similar sizes with different morphologies.

Figure 2C:
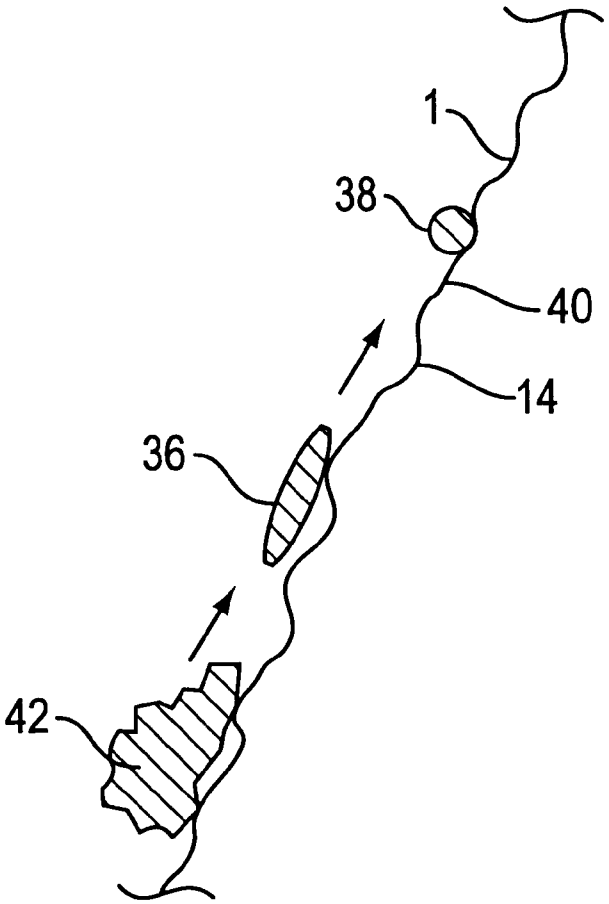
FIG. 2A, 2B and 2C are schematic representations of a separating surface of the present invention illustrating underlying principles of operation of the separators of the present invention.
Figure 2B:
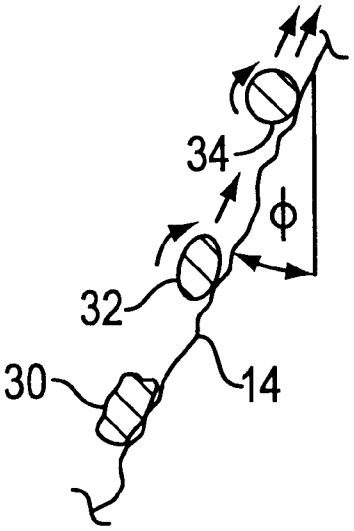
Figure 2A:
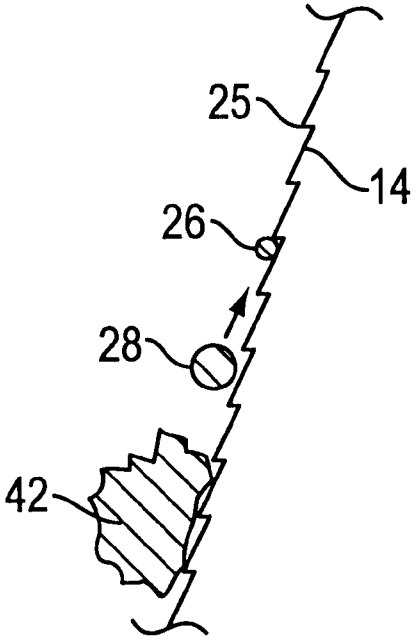

By way of schematic illustration, FIGS. 2A–2C show a number of different separation processes which can be implemented according to the teachings of the present invention. FIG. 2A shows an example of similar, generally round particles of different sizes. In this case, surface 14 is formed with a surface texture which includes barriers 25 designed to obstruct upward progress of particles 26 with a diameter less than or equal to D. Larger particles 28, on the other hand, overcome barriers 25 to travel upwards under the centrifugal effects of rotation. This separation process will be referred to herein as "barrier separation".

It will be clear that barriers 25 may assume a wide variety of shapes including, but not limited to step-shaped as shown here, or rectangular or rounded ridges. The choice of barrier shape and spacing determines the effective frictional roughness of the surface experienced by much larger particles. The size of the barriers required will clearly depend on the angle of inclination of surface 14 and the shape of barrier used. For a rectangular barrier at large inclination to the vertical (i.e., near horizontal), a step of approximately D/2 would be required. At smaller inclinations, a much smaller step is required.

Barriers 25 may be formed as substantially uniform ridges around the entirety of surface 14. Alternatively, barriers 25 may be implemented as localized recesses and projections in the surface structure of surface 14.

FIG. 2B shows an example of separation of particles according to their roughness and smoothness. Thus, a rough or abrasive particle 30 is retained by frictional forces in contact with surface 14. Depending on the choice of roughness and angle, a smoother but somewhat irregular particle 32 may tend to roll slightly, allowing it to work its way slowly upwards over surface 14. A near spherical particle 34, on the other hand, progresses much more quickly upwards. By selecting the appropriate roughness of surface 14, it is possible to change the effective friction coefficient of the components against the surface. For each component, an effective friction angle may be defined as the arctangent of the effective friction coefficient for that component. If the angle of inclination $\phi$ of surface 14 to the vertical is selected to be less than the effective friction angle for a given component, that component will be frictionally retained on revolving surface 14. Components with a lower effective friction angle will advance upwards across the surface. This separation process will be referred to herein as "frictional separation".

FIG. 2C shows a further example in which elongated particles 36 are separated from short particles 38 with similar transverse dimensions. Here, as in FIG. 2A, barriers 40 are formed in surface 14 to retain particles 38. Longer particles 36 generally overlie more than one barrier at a given time, preventing them from becoming lodged behind a barrier.

Clearly, by selecting the barrier shape, the frictional properties of surface 14 may be chosen so as to control more than one separation process simultaneously. For example, the ridged surface 14 of FIG. 2A may simultaneously serve to retain small particles 26 and much larger, high-friction particles 42. Conversely, the rounded surface 14 of FIG. 2C may offer low retention both to elongated particles 36 and large particles 42 so as to selectively retain small short particles 38.

It should be understood that the centrifugal separators of the present invention are applicable to an extremely wide range of component dimensions, from particle sizes of the order of centimeters down to sub-micron particle sizes. Of particular importance are smaller particles of dimensions less than about 1 mm, and most significantly, the range of between about 0.5 $\mu$m and about 40 $\mu$m, where conventional methods of separation are generally ineffective.

Turning now to the features of centrifugal separator 10 in more detail, surface 14 of bowl 12 is preferably subdivided into a number of differently angled and/or textured surfaces. Specifically, the part of surface 14 adjacent to lower edge 18 preferably forms an accelerator surface 44. Accelerator surface 44 has a relatively large inclination to the vertical (typically greater than the friction angle of both components) such that, with possible exceptions which will be described below, all material landing on the accelerator surface progresses upwards, gradually gathering angular momentum. This ensures that the contents of bowl 12 are turning with the bowl at sufficient speed for proper separation to occur on the higher surfaces.

The upper part of surface 14, lying adjacent to upper edge 16, is angled and textured according to the above-mentioned principles to achieve separation of two or more components of the mixture. Thus, in the case of frictional separation, surface 14 is inclined to the vertical at an angle between the effective friction angles of the first and second components.

In a preferred embodiment, quality of separation is improved by providing more than one separating surface such that a primary separation occurs on a lower separating surface 14*a* and an upper separating surface 14*b* serves as a quality control surface, close to cut-off conditions for allowing the low-friction component to advance. Typically, in the case of frictional separation, upper separating surface 14*b* is inclined to the vertical at between about 1° and about 5° more than the effective friction angle of the lower-friction component, whereas lower separating surface 14*a* is at a larger angle to the vertical, typically between about 5° and about 10° greater than the effective friction angle of the lower-friction component, but less that the effective friction angle of the higher-friction component.

Although lower and upper separating surfaces have been illustrated by way of example as having different inclinations, it will be clear that an equivalent effect could be achieved by providing the two surfaces with different surface characteristics, thereby changing the effective friction angles of each component between the two surfaces. In this case, the angular ranges mentioned above hold true for each surface in terms of its own effective friction coefficients with the two components. However, in some cases, the actual inclination of the surfaces could be equal.

In the case of barrier separation, it will be clear that an analogous effect of lower and upper separation surfaces may be achieved by varying the nature and/or dimensions of the barriers between the surfaces.

In the example shown in FIG. 1, each part of surface 14 is implemented as a cone of constant angle. As already mentioned, the transitions between the parts may correspond to changes in inclination, surface characteristics, or both.

Feed mechanism 24 is implemented as a rotating disk, typically fixed so as to rotate with bowl 12. The disk typically has a convex upper surface, for example an inverted conical shape as shown, to enhance radial distribution of a supplied mixture. The mixture is typically delivered to the feed mechanism through an input tube 46.

Bowl 12 is turned by drive mechanism 20 through shaft 48. Drive mechanism 20 typically includes a pulley 50 which can be coupled to any available source of rotational power (not shown).

Surrounding bowl 12 is a casing 52 which serves to contain material released from upper edge 16 of surface 14. Casing 52 has a sloped base 54 which conveys material to a first outlet chute 56.

Figure 11:
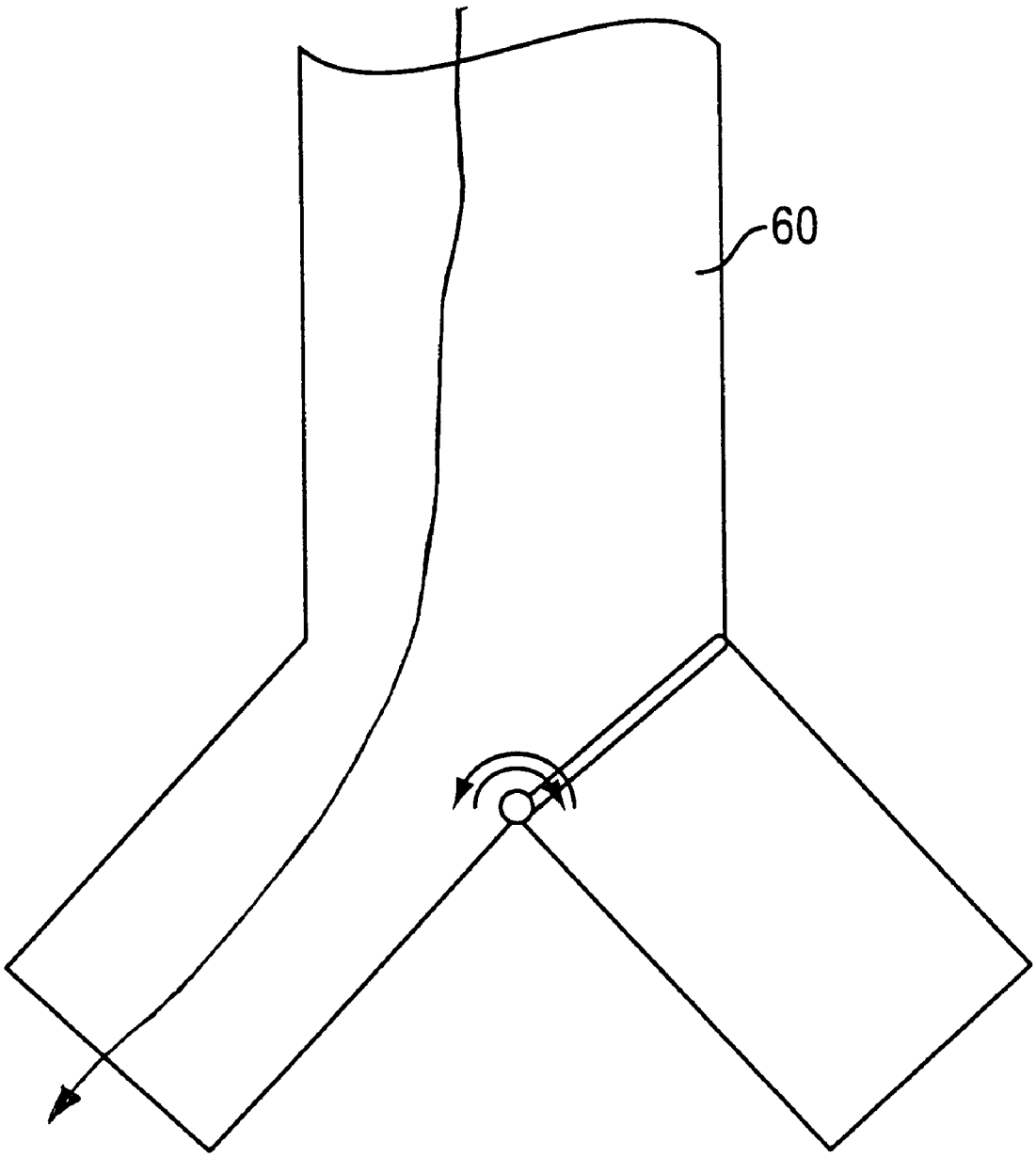
FIG. 11 is a transverse cross-sectional view through a preferred implementation of an output chute, for use with the lower output from any of the embodiments of the present invention.

Deployed below lower edge 18 is a funnel 58 leading to a second outlet chute 60. Chute 60 is preferably formed with tap structure so as to be switchable between two outlets, as best seen in FIG. 11. Chute 60 is switched to a first outlet position during rotation of the separator and the other just before rotation is stopped, thereby segregating two types of output as will be described below.

In use, drive mechanism 20 is actuated and a mixture of at least two components is fed down input tube 46 onto feed disk 24 from where it is distributed radially outwards to accelerator surface 44. In most cases, all components of the mixture accelerate to the angular velocity of bowl 12 and start to advance up across accelerator surface 44. On reaching the separator surface, the higher friction or smaller component becomes caught on the surface while the lower friction or larger component continues to advance upwards across the separator surface. As rotation of bowl 12 continues, the lower friction component starts to reach the upper edge 18 of surface 14 where it is released and funneled by casing 52 out through chute 56. On completion of separation of a batch of the mixture, i.e., when no more of the lower friction component is released from chute 56, drive mechanism 20 is deactivated so that bowl 12 stops. At this point, the higher friction or smaller component falls under the influence of gravity and is released through chute 60. In some applications, the release of the higher friction component may be assisted by a vibrator or percussion mechanism (not shown) associated with bowl 12 for dislodging the particles. Once bowl 12 has been emptied, separator 10 is ready for processing the subsequent batch of mixture.

In certain cases, a specific very low friction component may not receive sufficient angular momentum from accelerator surface 44 to be carried upwards at all. This is most often the case for very accurately spherical components with relatively high density which tend to roll rather than acquire momentum with the bowl. As a result, this specific type of component will be released downwards immediately on supply of the mixture into bowl 12. For this reason, chute 60 is preferably provided with a switchable outlet, as mentioned above.

Figure 3:
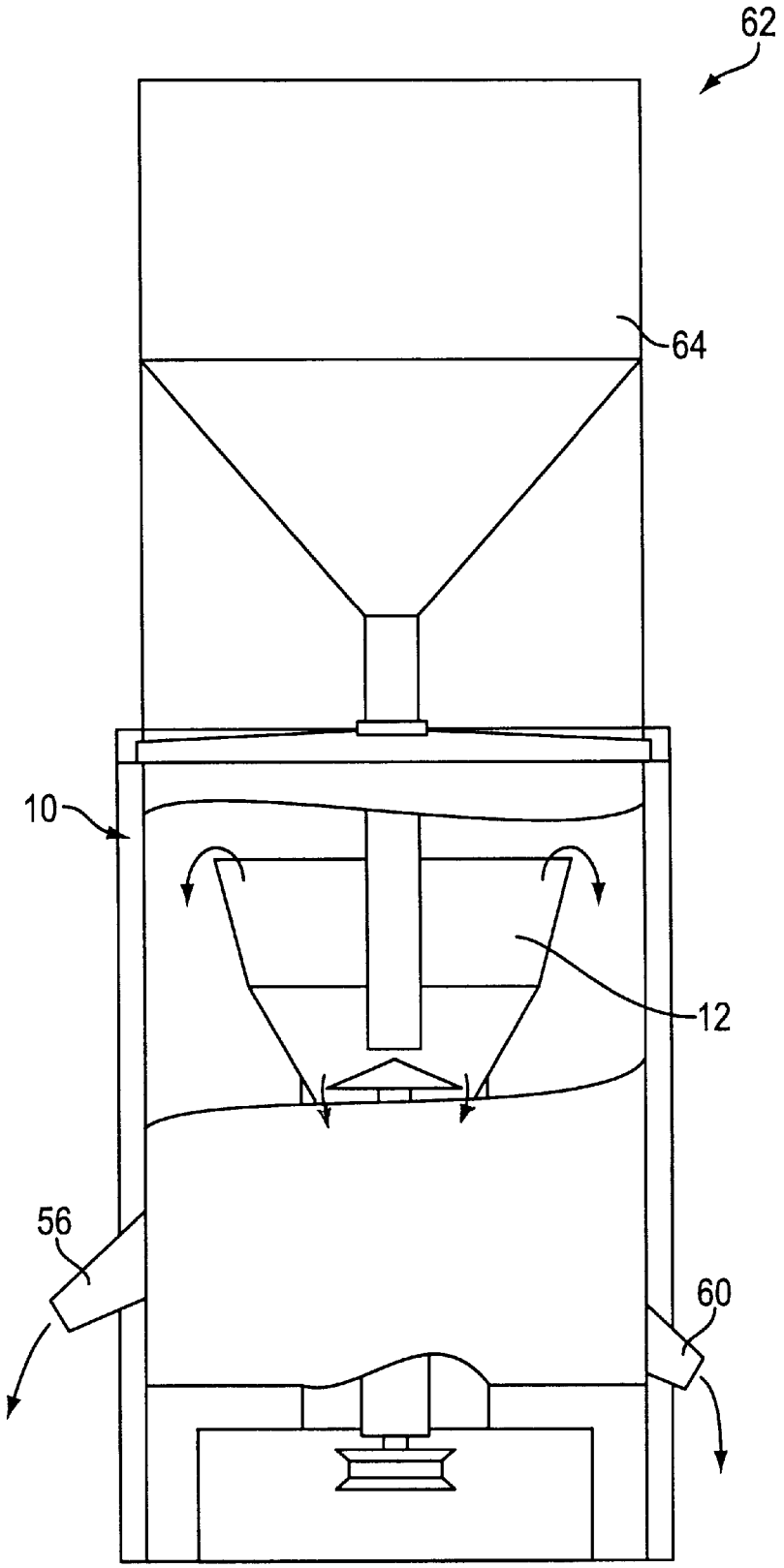
FIG. 3 is a side cross-sectional view of a through-flow implementation of the embodiment of FIG. 1.

Turning now to FIG. 3, this shows an implementation of centrifugal separator 10 to a through-flow system 62 in which input tube 46 is fed from an input bin 64, and output chutes 56 and 60 are external. This implementation allows efficient large scale processing in which batches of mixture are processed in repeated cycles with minimum delay for release of the higher friction component between successive cycles.

Figure 4B:
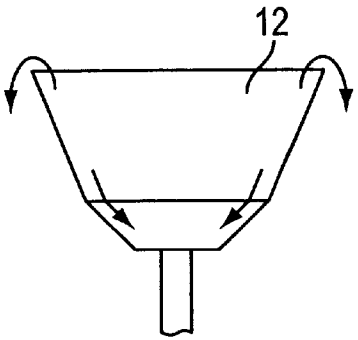
FIG. 4B is an alternative bowl design for use with the embodiment of FIG. 4A in processing of small quantities.
Figure 4A:
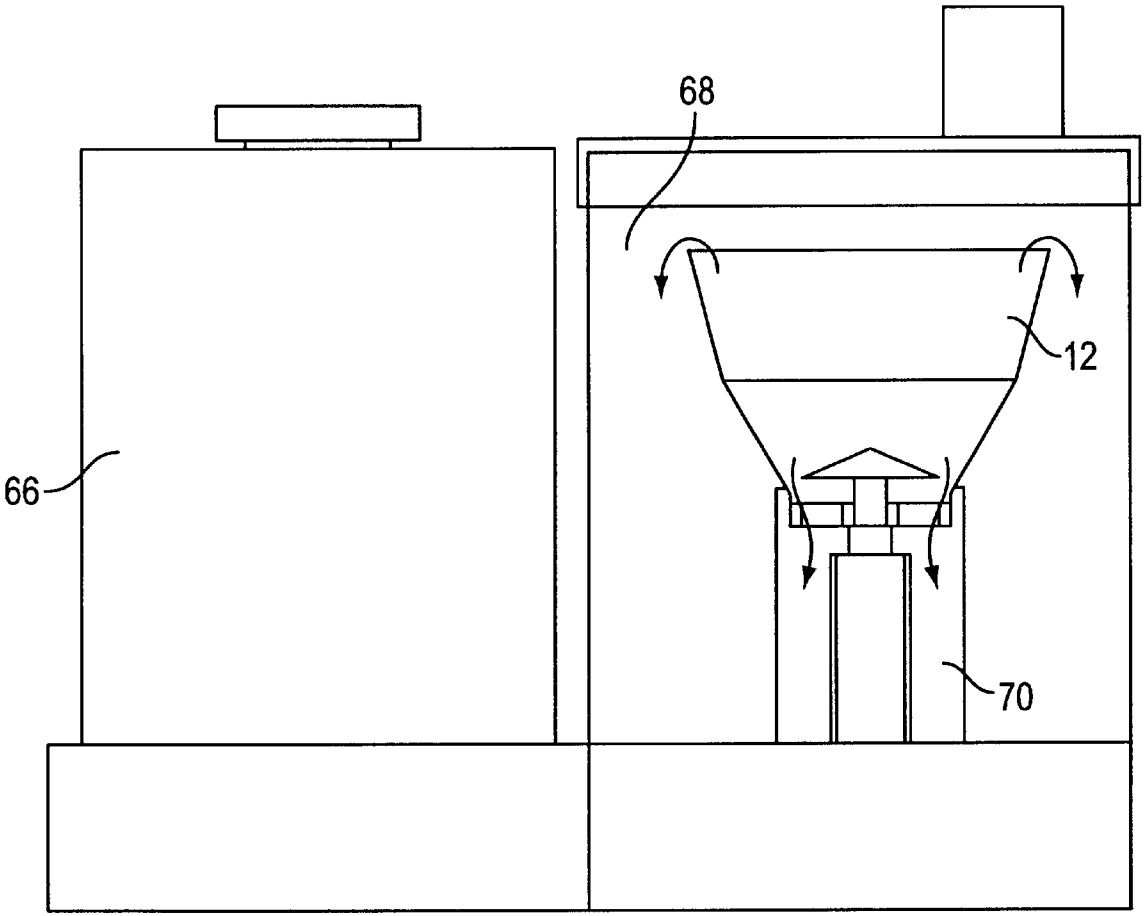
FIG. 4A is a side cross-sectional view of a single-batch implementation of the embodiment of FIG. 1.

FIG. 4A, on the other hand, shows an implementation of centrifugal separator 10 for small scale applications in the form of an accessory for a domestic food processor 66. Here, the structure is simplified in that chutes 56 and 60 are replaced by closed chambers 68 and 70, respectively, which must be emptied manually between each batch separated. FIG. 4B depicts a further simplification in which the lower outlet is omitted entirely such that bowl 12 has a closed base. In this case, small quantities of mixture can be processed as described above. At the end of each batch, bowl 12 is dissembled and inverted to release the higher friction component.

Figure 5:
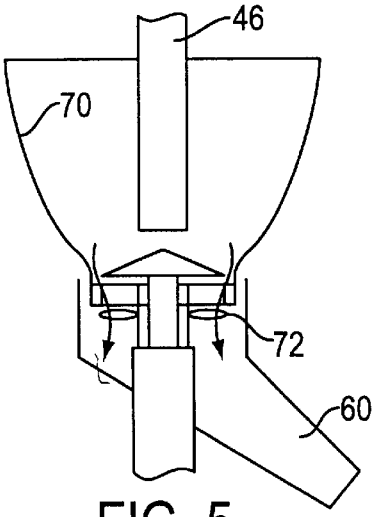
FIG. 5 is a partial side cross-sectional view showing of an alternative form of bowl for use in the embodiment of FIG. 1.

Turning now to FIG. 5, this shows an alternative bowl 70 for use with centrifugal separator 10. Bowl 70 is similar to bowl 12 described above except that the various surfaces are unified into a gradually curved shape. Functionally, different parts of the internal surface serve all the functions of the accelerator surface, lower and upper separator surfaces described above. Consequently, the inclination of bowl 70 typically correspond at its lower edge and upper edge to those described for the accelerator surface and upper separator surface, respectively.

An additional feature shown in FIG. 5, but applicable equally to all implementations of the present invention, is provision of a suction system 72 for causing a flow of air downwards within the bowl. Typically, suction system 72 features a fan or propeller element mounted below feed mechanism 24. Suction system 72 serves to draw out small airborne dust particles which might otherwise mix in with one or other of the separated components.

Figure 6:
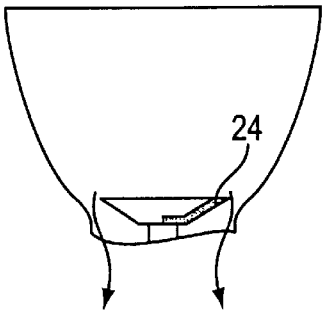
FIG. 6 is a partial side cross-sectional view showing a further variant of the embodiment of FIG. 1 employing a concave feeder disk.

FIG. 6 illustrates an alternative implementation of feed mechanism 24 as a disk with a concave or cup-shaped upper surface. This design ensures that material is not released radially until it has acquired a certain minimum rotational momentum. As a result, it prevents the early downwards release of certain low-friction components mentioned above.

Figure 7:
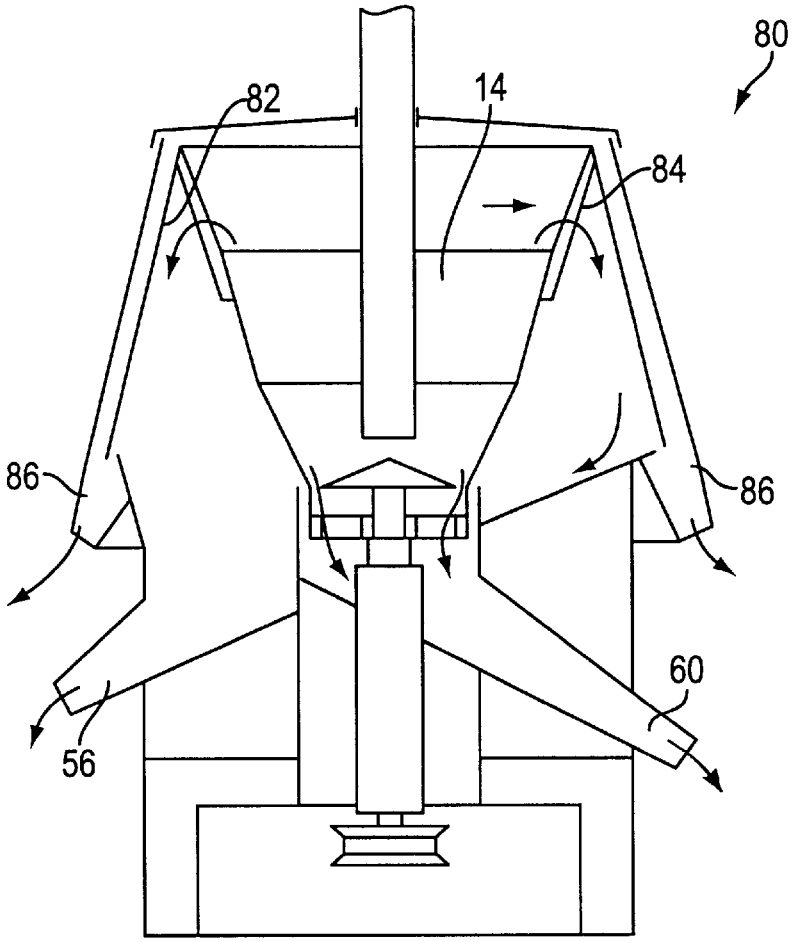
FIG. 7 is a side cross-sectional view of a second embodiment of a centrifugal separator, constructed and operative according to the teachings of the present invention, employing a supplementary inverted conical separator surface.
Figure 8:
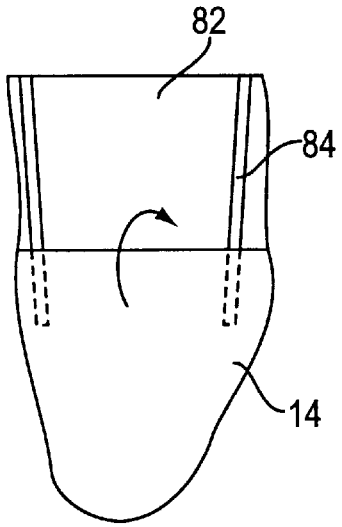
FIG. 8 is a partial cut-away view of the connection between the bowl and the supplementary separator surface of the embodiment of FIG. 7.

Turning now to FIGS. 7 and 8, a second embodiment of a centrifugal separator, generally designated 80, constructed and operative according to the teachings of the present invention, will now be described. Separator 80 is generally similar to separator 10 described above and equivalent elements are designated similarly. Separator 80 differs from separator 10 principally in that it employs a supplementary inverted conical separator surface 82.

Structurally, separator surface 82 is implemented as a secondary annular rotating surface circumscribing upper edge 16 of surface 14. Surface 82 is inclined downwardly outwards. Typically, surface 82 is connected to rotate as a unit with bowl 12. The connection can be achieved easily without significantly obstructing the release of material from upper edge 16 by use of a number of narrow rib elements 84.

In order to allow separation of components reaching surface 82, separator 80 features at least one additional outlet chute 86 deployed around the outer periphery of surface 82 so as to selectively collect material which has traveled across surface 82. The choice of inclination and surface characteristics of surface 82 may be understood by analogy to surface 14 discussed above. Additionally, surface 82 is particularly useful for cleaning large particles. The large particles fall from surface 82 and are released through outlet chute 56; dust and other higher friction components, on the other hand, travel across the surface under a combination of centrifugal and gravitational effects and are released from chute 86.

In operation, surface 82 provides an extra separation stage which allows separator 80 be used to separate three different components.

Figure 9:
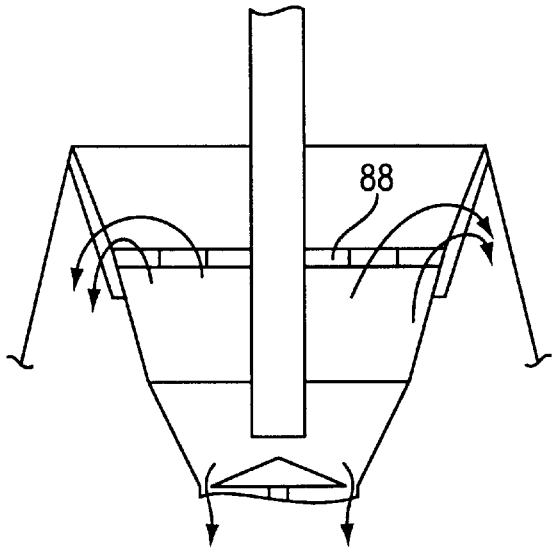
FIG. 9 is a partial side cross-sectional view showing a variant of the embodiment of FIG. 7 employing a mesh to generate an air turbulence barrier.

FIG. 9 illustrates an additional optional feature which may be employed to advantage in any of the embodiments of the present invention, namely, a structure 88 for generating turbulent air flow in a region adjacent to upper edge 16 of surface 14. This serves to inhibit upward passage of dust particles.

Structure 88 is preferably implemented as a mesh extending substantially horizontally within bowl 12. Mesh 88 is configured with relatively large openings so as to generate turbulent air flow without obstructing passage of large particles. The turbulent air flow serves as an effective barrier against upwards movement of light dust particles.

Figure 10:
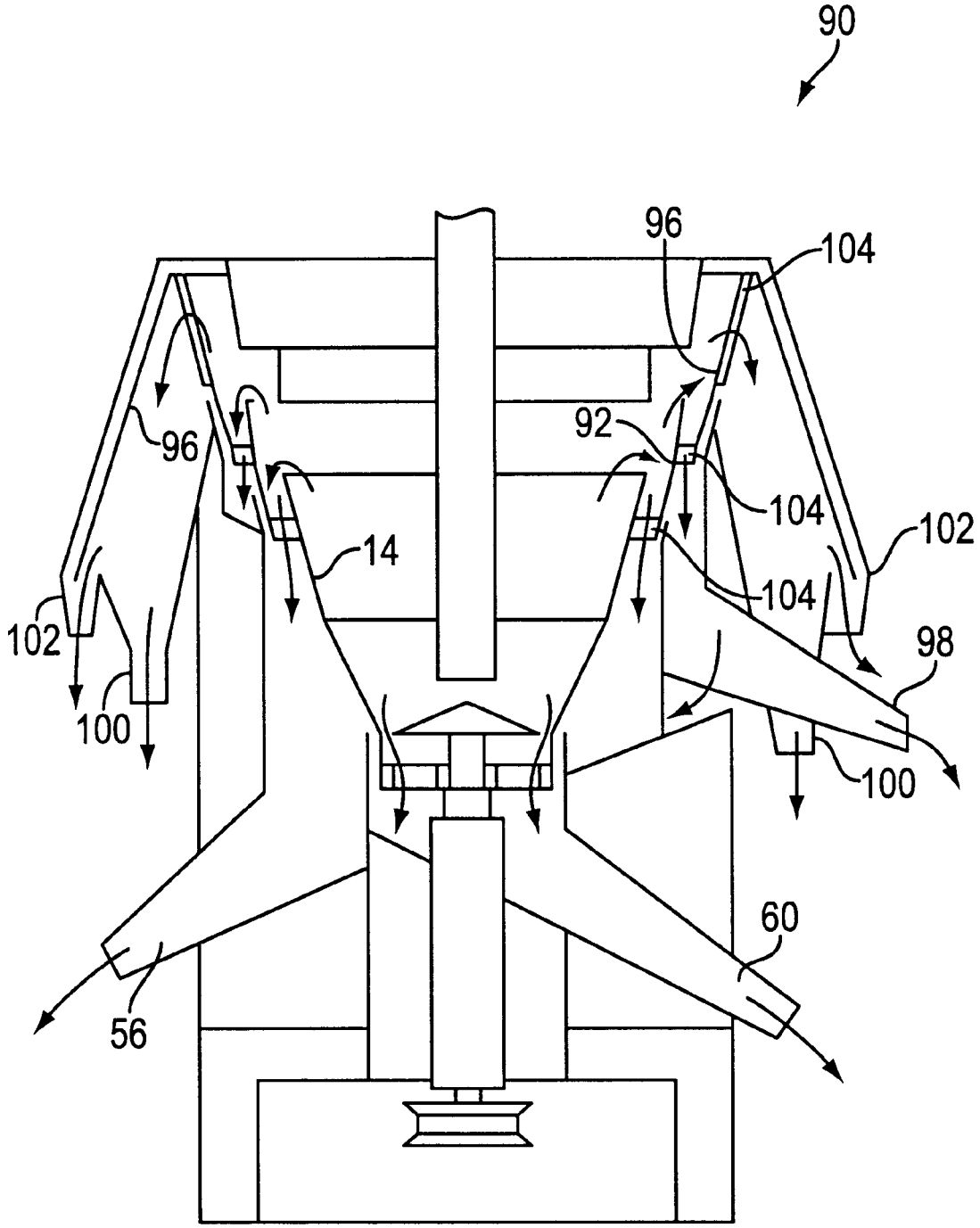
FIG. 10 is a side cross-sectional view of a third embodiment of a centrifugal separator, constructed and operative according to the teachings of the present invention, employing multiple separator surfaces.

Finally, turning to FIG. 10, there is shown a third embodiment of a centrifugal separator, generally designated 90, constructed and operative according to the teachings of the present invention. Separator 90 is also generally similar to separator 10 described above, differing primarily in that it employs a number of additional separator surfaces 92, 94 and 96. In this case, two of the additional surfaces (92 and 94) extend upwardly outwards while one (96) extends downwardly outwards.

As with supplementary surface 82 described above, surfaces 92, 94 and 96 are implemented as secondary annular rotating surfaces. In principle, any number of additional surfaces could be added, each sharing the same axis of rotation and positioned so as to circumscribe the upper edge of the next surface in. Thus, in this case, surface 92 circumscribes upper edge 16 of surface 14, whereas surface 94 circumscribes the upper edge of surface 92. Surface 96, in turn, circumscribes the upper edge of surface 94. An additional outlet chute 98, 100, 102 is provided for each additional separating surface. Here again, connection to bowl 12 may be achieved directly or indirectly by use of a number of narrow rib elements 104.

It will be readily appreciated that appropriate selection of inclinations and surface characteristics of surfaces 14, 92, 94 and 98 according to the principles described above allows highly efficient separation of at least five different components. In the preferred case of a switchable chute 60, six different components may actually be separated.

It will be appreciated that the above descriptions are intended only to serve as examples, and that many other embodiments are possible within the spirit and the scope of the present invention.

What is claimed is:

1. A separated-solid-component generating system comprising:

a dry mixture including a first component and a second component; and a centrifugal separator configured to separate the first component from the second component, the separator comprising:

an annular surface inclined upwardly outwards and having a vertical axis of symmetry, the annular surface comprising an upper edge, a lower edge, a first annular part, and a second annular part, the second annular part lying closer to the vertical axis of symmetry than the first annular part;

a drive mechanism coupled to the annular surface for rotating the annular surface around the vertical axis of symmetry; and a feed mechanism located centrally with respect to the annular surface for feeding the dry mixture onto the annular surface, wherein the first component has a first effective friction coefficient against the first annular part, and the second component has a second effective friction coefficient against the first annular part, the second effective friction coefficient being smaller than the first effective friction coefficient, and wherein the first annular part is inclined at an angle to the vertical axis of symmetry of between about 1° to about 5° greater than the arctangent of the second effective friction coefficient, and the second annular part is inclined at an angle to the vertical axis of symmetry of between about 5° to about 10° greater than the arctangent of the second effective friction coefficient.

2. The separator of claim 1, wherein the first annular part is textured to render the first effective friction coefficient greater than an inherent friction coefficient between materials of the first component and the annular surface.

3. The separator of claim 1, wherein the first annular part comprises a texture having the first effective friction coefficient, the first effective friction coefficient being greater than an inherent friction coefficient between materials of the first component and the annular surface.

4. The separator of claim 1, wherein the first annular part is disposed proximal to the upper edge.

5. The separator of claim 4, wherein the annular surface further comprises an accelerator surface disposed adjacent to the lower edge, the accelerator surface being inclined at an angle to the vertical axis of symmetry which is greater than the inclined angle of the first annular part.

6. The separator of claim 4, wherein the annular surface further comprises an accelerator surface disposed adjacent to the lower edge, the accelerator surface being inclined at an angle to the vertical axis of symmetry which is greater than the arctangent of the first effective friction coefficient.

7. The separator of claim 6, wherein the second annular part is disposed intermediate, between the first annular part and the accelerator surface.

8. The separator of claim 7, wherein each of the first annular part, the second annular part and the accelerator surface comprise a substantially conical surface.

9. The separator of claim 1, wherein the first component comprises a particle size of less than a given diameter D and wherein the second component comprises a particle size of greater diameter than D, the first annular part being formed with barriers which trap particles of the first component and allow particles of the second component to move across the annular surface and up over the upper edge.

10. The separator of claim 9, wherein D is less than about 1 mm.

11. The separator of claim 9, wherein D is less than about 40 $\mu$m.

12. The separator of claim 11, wherein D is in the range of between about 5 $\mu$m and about 40 $\mu$m.

13. The separator of claim 1, wherein the feed mechanism comprises a rotating disk.

14. The separator of claim 1, wherein the first component comprises particles having a diameter D, and wherein the annular surface comprises barriers which obstruct the movement of particles having a diameter of less than D or equal to D, and wherein the second component comprises particles having a diameter greater than D, the barriers allowing the particles of the second component to move across the annular surface and up over the upper edge.

15. The separator of claim 14, wherein the barriers comprise one of substantially uniform ridges and localized recesses and projections.

* * * * *